US007077681B2

(12) United States Patent
Behoo

(10) Patent No.: US 7,077,681 B2
(45) Date of Patent: Jul. 18, 2006

(54) WELDING CONNECTOR

(76) Inventor: Ronald James Behoo, 16 Pinecliffe Drive, Mississauga, Ontario (CA) L5N 1E3

( * ) Notice: Subject to any disclaimer, the term of this patent is extended or adjusted under 35 U.S.C. 154(b) by 0 days.

(21) Appl. No.: 11/004,774

(22) Filed: Dec. 3, 2004

(65) Prior Publication Data

US 2005/0136716 A1 Jun. 23, 2005

Related U.S. Application Data

(60) Provisional application No. 60/526,529, filed on Dec. 3, 2003.

(51) Int. Cl.
*H01R 4/50* (2006.01)

(52) U.S. Cl. ..... 439/333; 439/889

(58) Field of Classification Search ..... 439/333, 439/337, 338, 889, 814
See application file for complete search history.

(56) References Cited

U.S. PATENT DOCUMENTS 2,046,221 A * 6/1936 Thomas ..... 337/187
2,911,616 A * 11/1959 Townsend ..... 439/866
3,226,667 A * 12/1965 Robert, Jr. ..... 439/282
4,702,539 A 10/1987 Cusick, III et al.
5,685,730 A * 11/1997 Cameron et al. ..... 439/335
6,309,231 B1 * 10/2001 Gordon et al. ..... 439/140

* cited by examiner

*Primary Examiner*—Tho D. Ta
(74) *Attorney, Agent, or Firm*—Young & Basile, P.C.

(57) ABSTRACT

An assembly is disclosed and comprises a pair of connectors, each including a body which securely receives in electrically-conducting relation the end of a welding cable and a sleeve which, in use, forms a grip for the body and receives same in a manner which provides access to the receiver for the cable end at one end and provides access to the body at the other end. The pair has: an initial position wherein they define a longitudinal axis and wherein the sleeves are disposed other end-to-other end, aligned with the axis; a primary lock, which locks the connectors against longitudinal movement relative to one another upon rotation of the connectors relative to one another about the axis from the initial position and permits electrical conduction between the bodies when the connectors are so locked; and a secondary lock which selectively arrests relative rotation of the connectors about the axis.

18 Claims, 6 Drawing Sheets

WELDING CONNECTOR

This application claims benefit of the filing date of and right of priority of U.S. Provisional Patent Application Ser. No. 60/526,529 filed Dec. 3, 2003 under 35 USC §119(e).

FIELD OF THE INVENTION

This invention relates generally to welding equipment, and more particularly, relates to welding cable connectors, that is, connectors for use with welding cable.

BACKGROUND OF THE INVENTION

It is well known in the prior art to provide connector systems for welding cable.

One common form of connector system is of the general type described in U.S. Pat. No. 4,702,539 (Cusick III, et al.), issued Oct. 27, 1987. In this type of connector system, a pair of connectors, said pair comprising a male connector and a female connector, is provided. Each connector includes a body and a sleeve. The body is constructed from electrically-conductive material, such as brass, and includes receiver means for securely receiving in electrically-conducting relation the end of a welding cable. The receiver means may take the form of a set screw arrangement. The sleeve is constructed out of electrically-insulative material, receives the body in snug-fitting relation, and is tubular, so as to provide access for the welding cable at one end, and to provide access to the body at the other end. The male connector has a conductive connector post projecting from its body, through the other end of its sleeve. The female connector has a socket formed in its body accessible through the other end of its sleeve. The post and the socket are adapted such that the post can be inserted into the socket to a position whereat the sleeves of the male and female connectors abut, thus defining an initial position of the connectors, and are further adapted, through the provision of suitable camming surfaces, such that rotation of the connectors from the initial position (i) draws the bodies of the male and female connectors against one another, thereby to permit electrical conduction therebetween, and, contemporaneously (ii) compresses the sleeves against one another, to provide frictional engagement therebetween. Such frictional engagement provides resistance to relative rotation of the connectors, thereby to resist disengagement.

This connector system is relatively inexpensive to manufacture, relatively durable and thus able to withstand heavy and continuous use, and has proven relatively useful. However, it suffers in that, over time, the various surfaces in the connectors can wear, thereby to reduce frictional engagement and render the connector system relatively more prone to inadvertent disengagement. This problem is most evident when the cables are strung in series up a scaffolding or the like, since the weight of the cables can cause the connectors to unscrew from one another and release, particularly when the junction between the connectors has become loose through wear.

SUMMARY OF THE INVENTION

A welding connector assembly for joining two welding cables forms one aspect of the invention. The welding connector assembly comprises a pair of welding connectors. Each welding connector includes a body and a tubular sleeve. The body is constructed from electrically-conductive material and includes receiver means for securely receiving in electrically-conducting relation an exposed end of a respective one of said welding cables. The tubular sleeve is constructed from electrically-insulative material. The sleeve, in use, forms a grip for the body and receives the body in a manner which provides access to the receiver means of the body for the exposed end of said respective cable at one end and which provides access to the body at the other end. The pair of welding connectors have an initial position wherein they define a longitudinal axis and wherein the tubular sleeves are disposed in end-to-end relation, aligned with the longitudinal axis and with the other ends of the tubular sleeves disposed adjacent one another. The pair of welding connectors also have primary locking means: for locking the welding connectors against longitudinal displacement from one another upon rotation of the welding connectors relative to one another about the longitudinal axis from the initial position; and for permitting electrical conduction between the bodies when the welding connectors are locked against longitudinal displacement. The pair of welding connectors also have secondary locking means for selectively arresting rotation of the welding connectors relative to one another about the longitudinal axis.

An improved welding connector forms another aspect of the invention. The improved connector is of the type having a body and a tubular sleeve. The body is constructed from electrically-conductive material and includes receiver means for securely receiving in electrically-conducting relation an exposed end of a respective one of said welding cables. The sleeve is constructed from electrically-insulative material. The sleeve, in use, forms a grip for the body and receives the body in a manner which provides access to the receiver means of the body for the exposed end of the respective cable at one end and which provides access to the body at the other end. The improved connector is further of the type used in pairs for joining two welding cables. The pair, in use, has an initial position wherein they define a longitudinal axis and wherein the tubular sleeves are disposed in end-to-end relation, aligned with the longitudinal axis and with the other ends of the tubular sleeves disposed adjacent one another. The pair also includes primary locking means: for locking the welding connectors against longitudinal displacement from one another upon rotation of the welding connectors relative to one another about the longitudinal axis from the initial position; and for permitting electrical conduction between the bodies when the welding connectors are locked against longitudinal displacement. The improvement comprises a groove formed in the welding connector and a slide for the groove. The slide includes a tongue portion mounted for sliding movement in the groove and moveable, through manual manipulation, between a retracted position, whereat it lies substantially within said groove, and an extended position, whereat it projects beyond said groove.

DETAILED DESCRIPTION OF THE INVENTION

Figure 1:
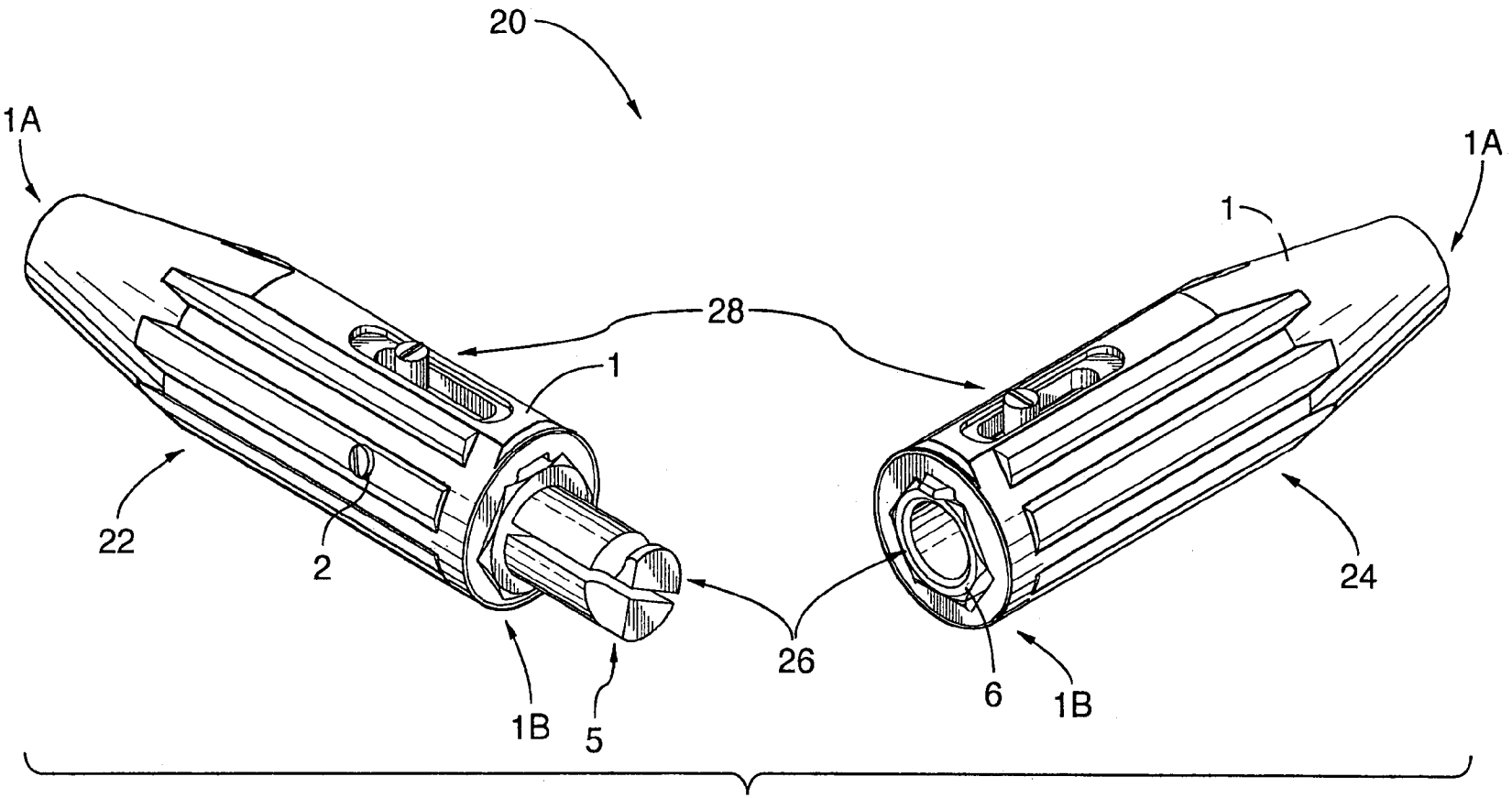
FIG. 1 shows a welding connector assembly according to the preferred embodiment of the present invention.

FIG. 1 shows a welding connector assembly 20 according to a preferred embodiment of the present invention. The welding connector assembly 20 is for joining two welding cables (not shown in FIG. 1) and comprises a pair of welding connectors 22,24, the pair including a first connector 22 and a second connector 24. Each welding connector 22,24 includes a body 5,6 and a tubular sleeve 1,1, and the pair of welding connectors 22,24 includes a primary lock 26 and a secondary lock 28.

Figure 2:
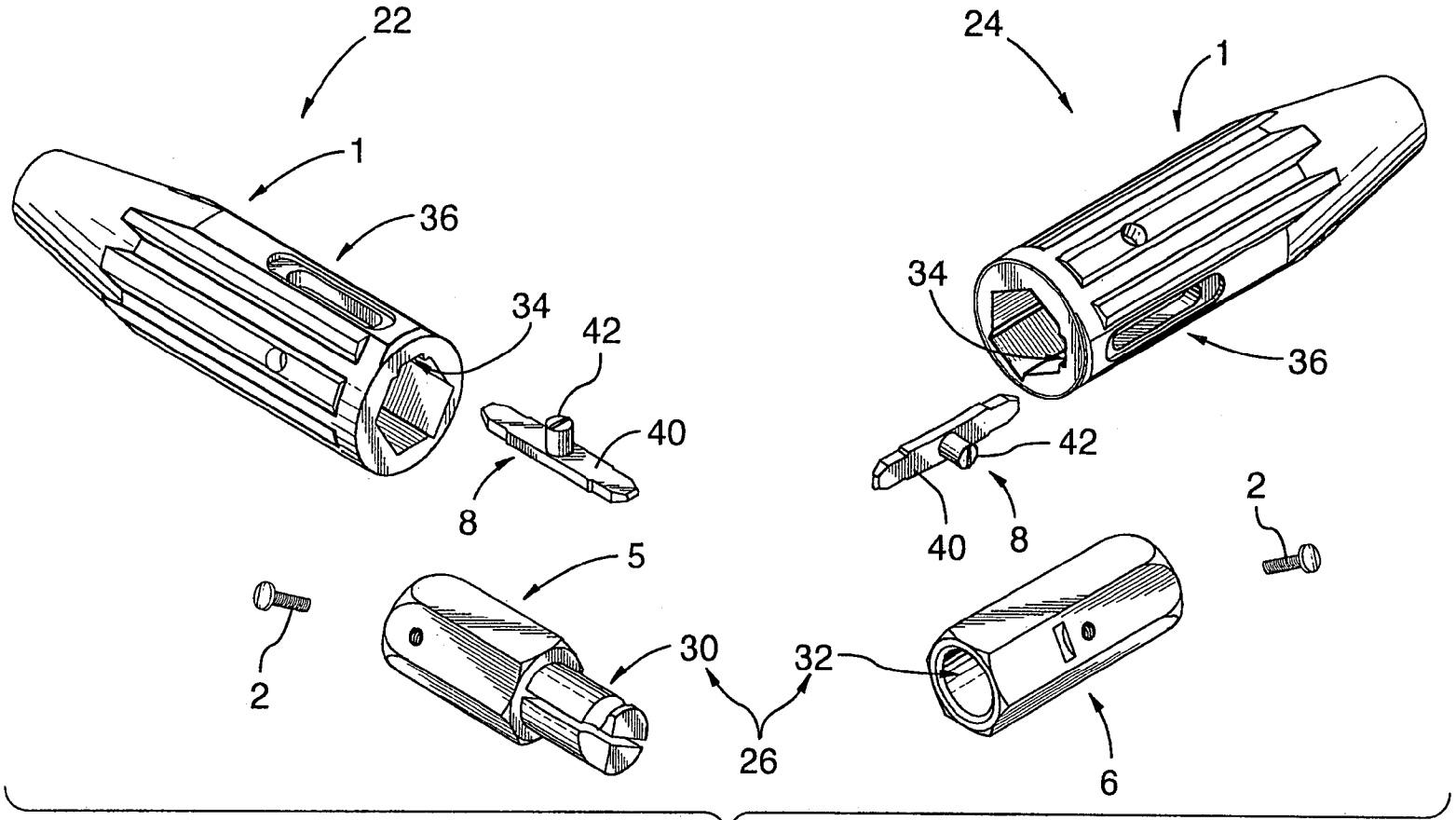
FIG. 2 shows the-welding connector assembly of FIG. 1 partially dissembled.

FIG. 2 shows the welding connectors 22,24 dissembled, to provide a view of, inter alia, the bodies 5,6 and sleeves 1,1.

Each body 5,6 is constructed from electrically-conductive material, specifically brass, although other materials can be used.

Figure 3:
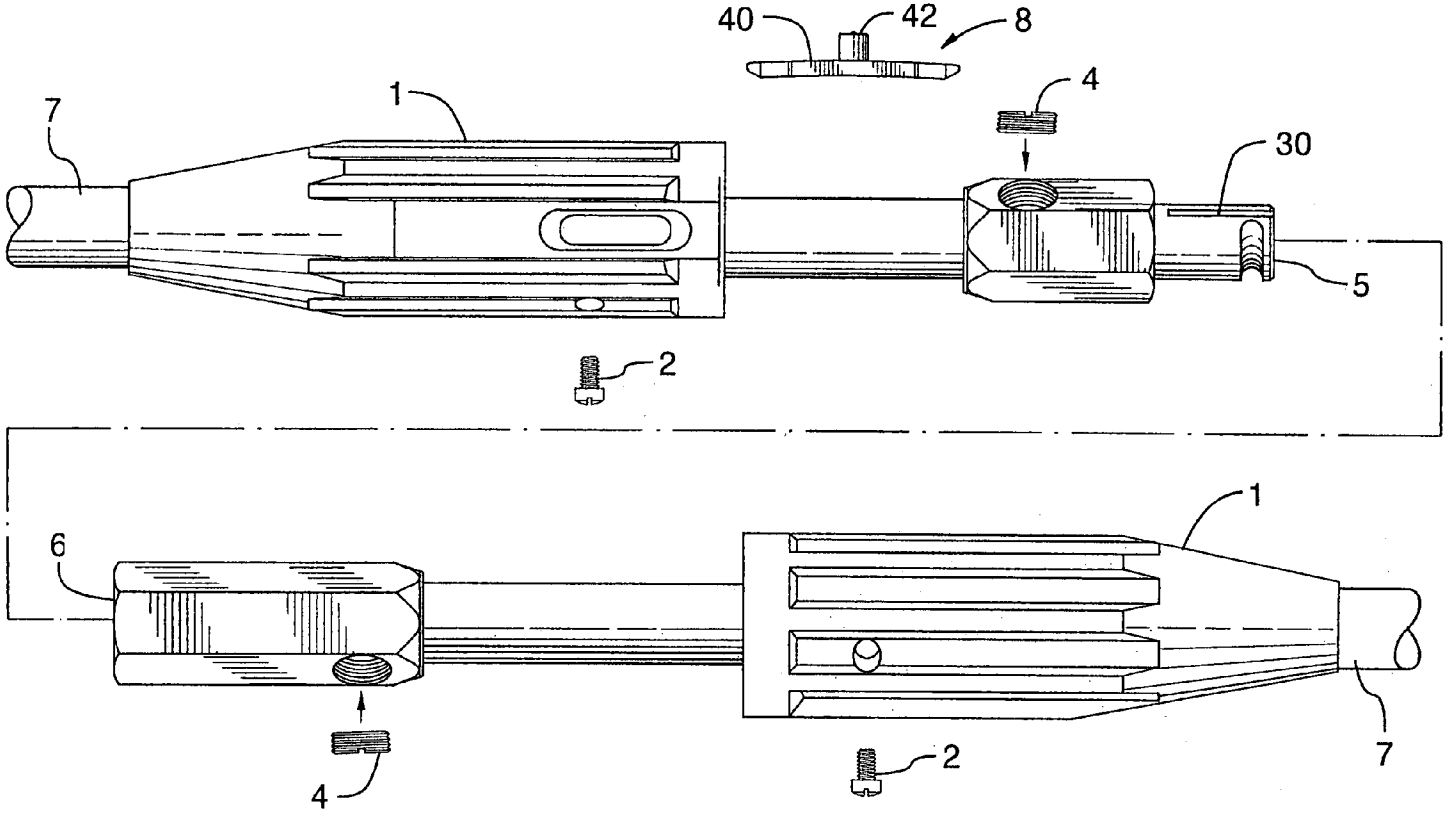
FIG. 3 shows the welding connector assembly of FIG. 2 fully dissembled, and with welding cables threaded through the sleeves.

FIG. 3 is a view similar to FIG. 2, but also showing cables 7,7 with exposed ends threaded through the sleeves 1,1 and the bodies 5,6 disassembled. Each body 5,6 includes receiving means for securely releasably receiving in electrically-conducting relation an exposed end of a respective one of said welding cables 7,7. The receiving means takes the form of a recess in the end of the body 5,6 adapted to releasably receive the exposed end of the cable 7,7, and a set screw 4 threaded through a portion of the body 5,6 and manipulable to impinge upon the received end and retain same in place, that is, to secure same against withdrawal from the recess. Other configurations are possible. The recess is identified with reference numeral 44 in FIGS. 8,9.

Returning to FIG. 2, the sleeves 1,1 are tubular and constructed out of electrically-insulative material, more specifically, they are injection-molded out of "no-break" polypropylene. Other constructions are possible.

Returning to FIG. 1, in the assembled connectors 22,24, the sleeves 1,1 are in receipt of the bodies 5,6 in a manner which (i) provides access to the receiving means for the exposed end of said respective cable (cable not shown in FIG. 1) at one end 1A and provides access to the body 5,6 at the other end 1B; (ii) and forms a grip for the body 5,6, to permit manual manipulation thereof. In the preferred embodiment, the sleeves 1,1 are secured to the bodies 5,6 by screws 2,2.

Figure 4:
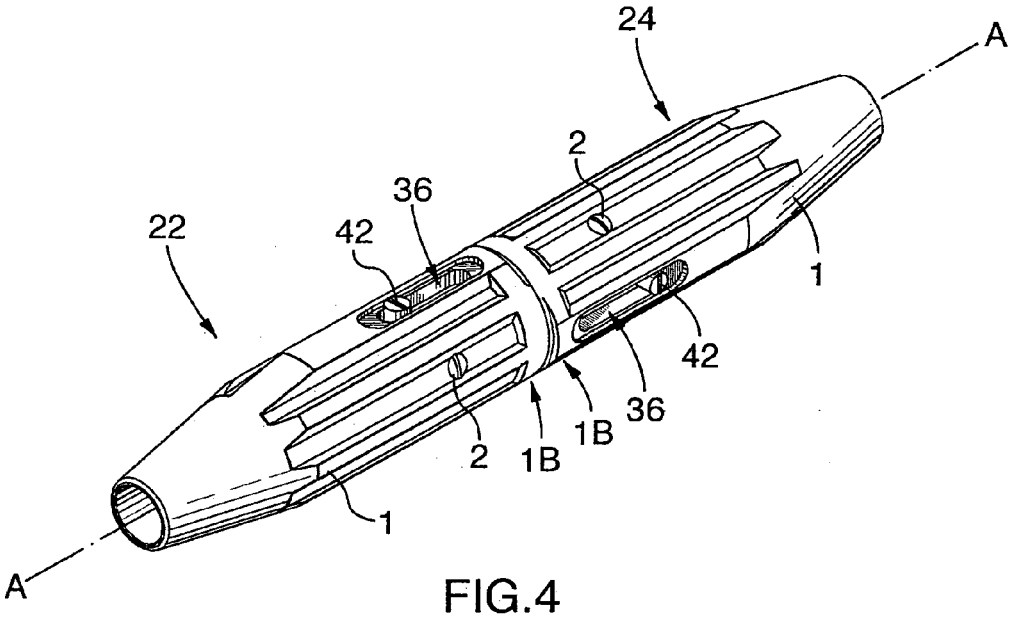
FIG. 4 shows an initial position of the pair of assembled connectors of FIG. 1.

FIG. 4 shows an initial position of the pair of assembled connectors 22,24 in which the sleeves 1,1 are disposed in end-to-end relation, aligned with a longitudinal axis A—A defined by the pair 22,24, with the other ends 1B,1B of the sleeves 1,1 disposed adjacent to one another, more specifically, abutting.

Figure 5:
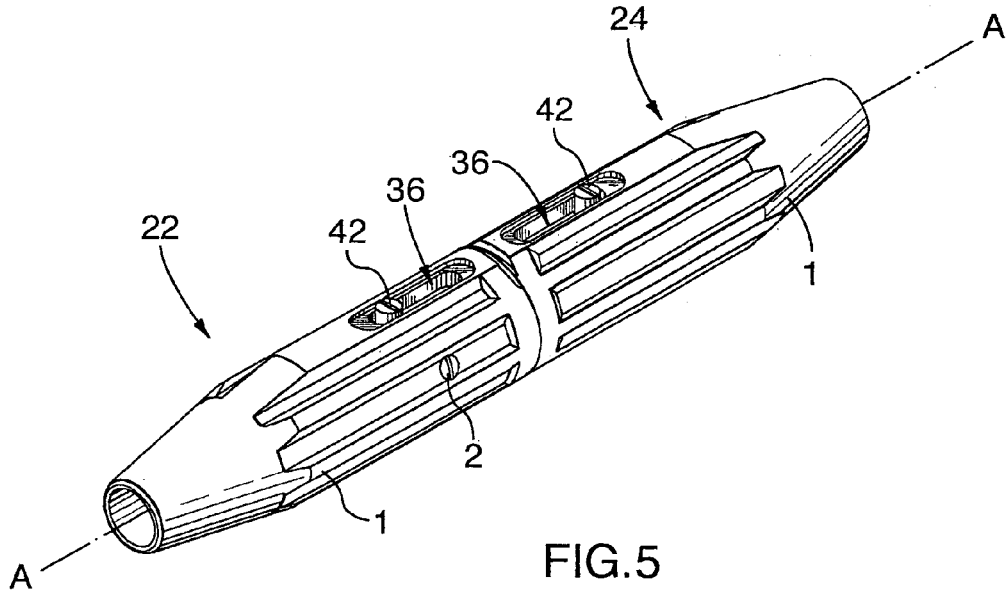
FIG. 5 shows a locking position of the pair of welding connectors of FIG. 4.

FIG. 5 shows a locking position of the pair of connectors 22,24, wherein the pair 22,24 are rotated relative to one another about the longitudinal axis A—A away from the position shown in FIG. 4.

Figure 8:
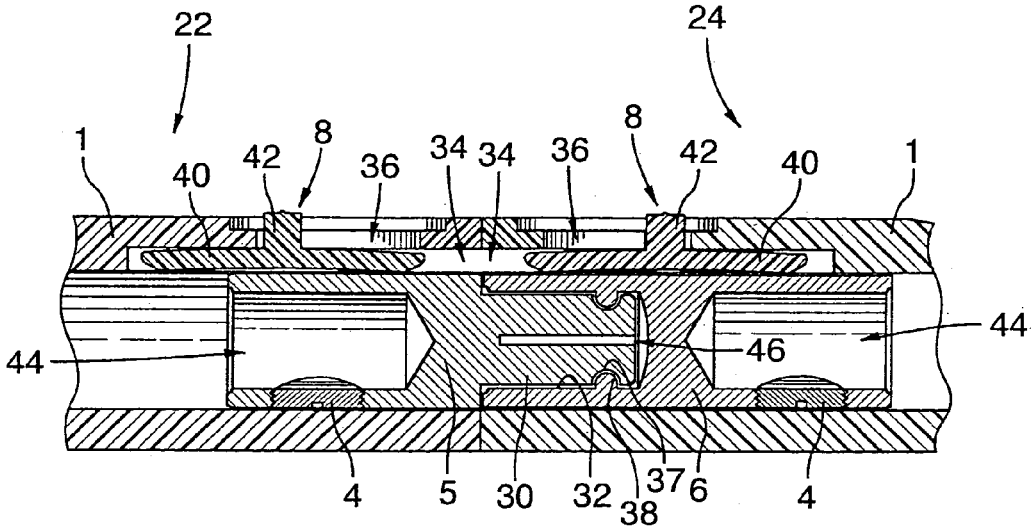
FIG. 8 is a cross-sectional view along line 8—8 of FIG. 7.
Figure 9:
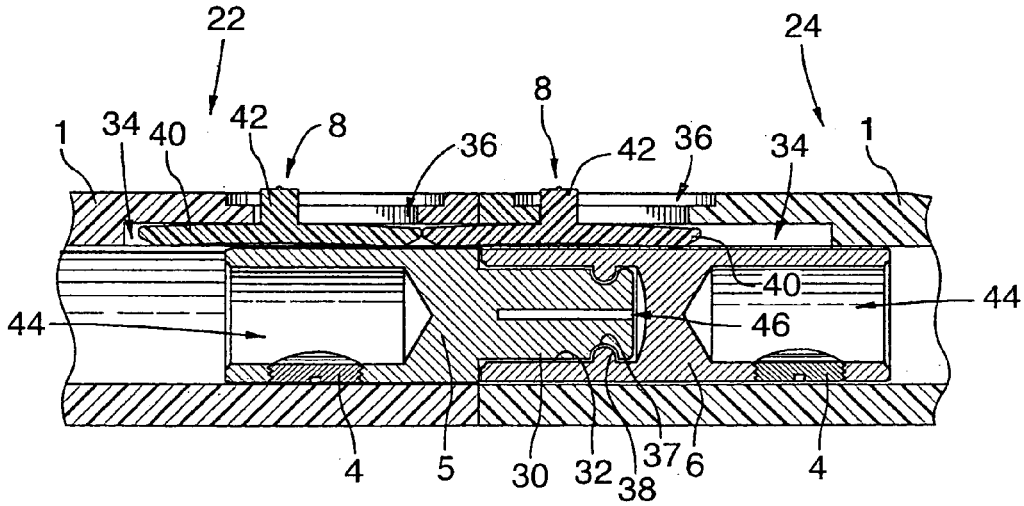
FIG. 9 is a view similar to FIG. 8, but showing a slide in an extended position.

Referring now to FIGS. 1, 8, 9 the primary lock 26 is a primary lock means for locking the connectors 22,24 against longitudinal displacement from one another upon relative rotation of the connectors 22,24 relative to one another about the longitudinal axis A—A, away from the initial position. In the preferred embodiment, the primary lock 26 includes a conductive connector post 30 projecting from the body 5 of the first connector 22, through the other end of the sleeve 1 thereof, and a socket 32 formed in the body 6 of the second connector 24, accessible through the other end of the sleeve 1 thereof, the post 30 and socket 32 being adapted to draw the bodies 5,6 of the first 22 and second 24 connectors against one another, through camming coaction, upon rotation of the connectors 22,24 relative to one another about the longitudinal axis A—A from the initial position to the locking position. This permits electrical conduction between the bodies 5,6 of the first 22 and second 24 connectors, and also compresses the sleeves 1,1 against one another, which provides frictional engagement between the sleeves 1,1, to resist rotation of the connectors 22,24 relative to one another. The camming coaction is provided by a pair of camming surfaces 37, 38, angled to one another and formed, respectively, on the post 30 and in the socket 32. The construction of such camming surfaces is well-known to persons of ordinary skill in the art, as, for example, described in U.S. Pat. No. 4,702,539 (Cusick III, et al.), issued Oct. 27, 1987, incorporated herein by reference, and moreover, various configurations thereof are possible. As such, details are not provided herein.

Turning now to FIGS. 1, 8, 9, the secondary lock 28 is a secondary lock means for selectively arresting rotation of the connectors. 22,24 relative to one another about the longitudinal axis A—A. In the preferred embodiment, the secondary lock takes the form of: a longitudinal groove 34 formed interiorly of each connector 22,24 and arranged so as to align with one another when the connectors 22,24 are disposed at the locking position; a longitudinal slot 36 formed through each sleeve 1, contiguous with the groove 34 thereof; and a slide 8 for each groove 34. Each slide 8 includes a tongue portion 40 mounted for axial sliding movement in the groove 34 for which said slide 8 is provided, and moveable, through manual manipulation and when the connectors 22,24 are disposed at the locking position, between a retracted position, as in FIG. 8, whereat it lies apart from the groove of the other connector, that is substantially within the groove 34 for which it is provided, and an extended position, as in FIG. 9, whereat it projects beyond the groove 34 for which it is provided, that is, lying in both grooves 34,34, thereby to arrest relative rotation of the sleeves 1,1.

To clarify, in FIG. 9, two slides 8 are shown; only one is shown at the extended position.

As best seem in FIG. 8, the groove 34 is defined by a channel formed on the interior of the tubular sleeve 1,1 and by the exterior of the body 5,6, and, as best seen in FIG. 3, the tongue portion 40 is slightly bowed, so as to bear against the body 5,6 and the sleeve 1,1 and provide resistance against movement of the slide 8 between the extended and retracted positions. The slide 8 also includes a button portion 42 rigidly extending from the tongue portion 40 through the slot 36, to permit digital manipulation of the slider between the extended and retracted positions.

Figure 6:
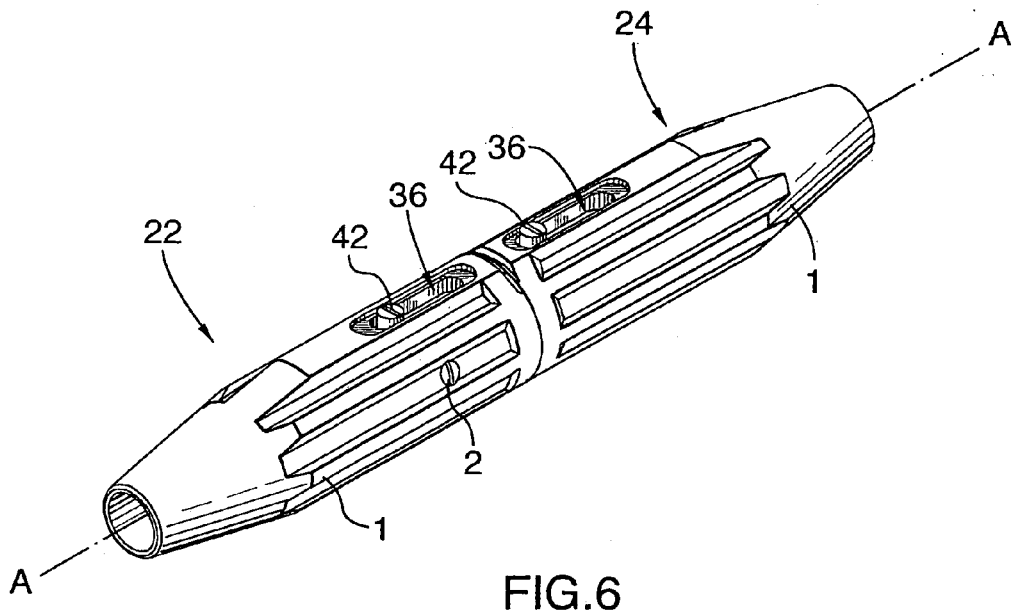
FIG. 6 is a view similar to FIG. 5, but showing a slide in an extended position.
Figure 7:
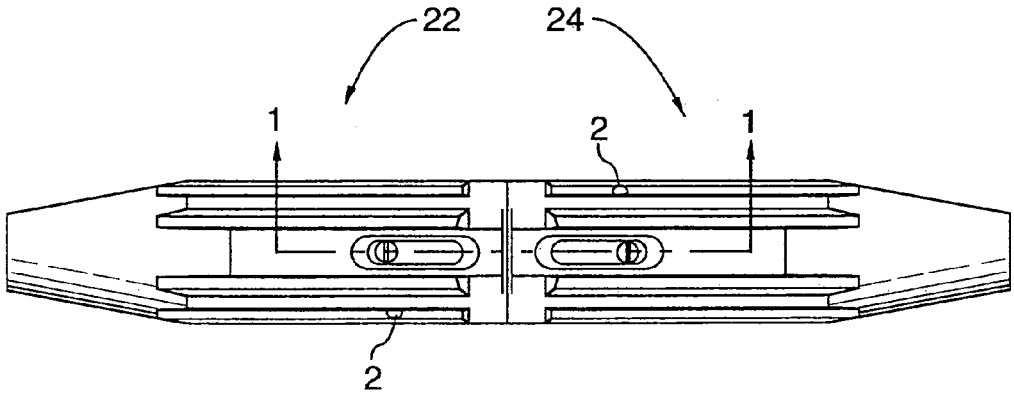
FIG. 7 is a top plan view of the structure of FIG. 5.

To use the connector system 20, welding cable 7,7 is first threaded through respective sleeves 1,1. Thence, insulation is removed from the cable ends (if it has not already been removed), the exposed ends are inserted into the recesses 44,44 in the bodies 5,6 and the set screws 4,4 are tightened, to secure the cables 7,7. Slides 8 are fitted into sleeves 1,1, with the button portions 42 projecting through the slots 36 and the tongue portions 40 fitted into the grooves 34. Bodies 5,6 are then slid into sleeves 1,1, and secured thereto by screws 2. With the parts thus assembled, the connectors 22,24 may be placed into the initial position, as shown in FIG. 4 and thereafter, twisted relative to one another into their locking position shown in FIG. 5. At the locking position, either one of the slides 8 may be manually manipulated to its extended position, as in FIG. 6, to lock the connectors 22,24 relative to one another.

Various modifications may be made to the connector assembly 20 without departing from the spirit or scope of the invention. It should also be appreciated that connectors constructed according to the invention may be utilized with connectors of the prior art, although, of course, the secondary locking functionality would not be available for use. Yet further, it should be understood that whereas in the preferred embodiment, a measure of electrical conduction can occur between the connectors whenever the post is disposed within the socket, irrespective of whether the connectors are in the initial or locking position, this need not be the case. Indeed, it could be quite advantageous in some circumstances to ensure that electrical conduction does not take place unless the connectors are disposed at the locking position; this provides a mechanism for persons to ensure that all connectors are locked.

Accordingly, it should be understood that the scope of the present invention is to be limited only by the claims appended hereto, purposively construed.

The invention claim is:

1. A welding connector assembly for joining two welding cables, said welding connector assembly comprising:

a pair of welding connectors, each welding connector including:

a body constructed from electrically-conductive material and including receiver means for securely receiving in electrically-conducting relation an exposed end of a respective one of said welding cables; and a tubular sleeve constructed from electrically-insulative material, the sleeve, in use, forming a grip for the body and receiving the body in a manner which provides access to the receiver means of the body for the exposed end of said respective cable at one end and which provides access to the body at the other end;

said pair of welding connectors having:

an initial position wherein they define a longitudinal axis and wherein the tubular sleeves are disposed in end-to-end relation, aligned with the longitudinal axis and with the other ends of the tubular sleeves disposed adjacent one another;

primary locking means: for locking the welding connectors against longitudinal displacement from one another upon rotation of the welding connectors relative to one another about the longitudinal axis from the initial position to a locking position; and for permitting electrical conduction between the bodies when the welding connectors are locked against longitudinal displacement; and a secondary lock for selectively arresting rotation of the welding connectors relative to one another about the longitudinal axis, said secondary lock comprising a groove formed in each welding connector, the grooves being arranged so as to align with one another when the welding connectors are disposed at the locking position; and a slide for one of said grooves, the slide including a tongue portion mounted for sliding movement in said one groove and moveable, through manual manipulation and when the welding connectors are disposed at the locking position, between a retracted position, whereat it lies apart from the other of said grooves, and an extended position, whereat it projects from said one groove into the other of said grooves.

2. A welding connector assembly according to claim 1, wherein the sleeves are injection molded out of no-break polypropylene.

3. A welding connector assembly according to claim 1, wherein the primary locking means draws the bodies of the welding connectors towards one another upon rotation of the welding connectors relative to one another about the longitudinal axis from the initial position.

4. A welding connector according to claim 1, wherein the receiver means is for securely, releasably receiving in electrically-conducting relation the exposed end of the respective cable.

5. A welding connector assembly according to claim 4, wherein, in each welding connector, the body has defined therein a recess adapted to releasably receive the exposed end of the respective welding cable.

6. A welding connector assembly according to claim 5, wherein each body further comprises a set screw which is threaded through a portion of said each body to impinge, in use, upon the received exposed end of the respective cable, to secure same against withdrawal from the recess, the recess and the set screw together defining the receiver means of said each body.

7. A welding connector assembly according to claim 3, wherein the primary locking means draws the bodies of the welding connectors against one another upon rotation of the welding connectors relative to one another about the longitudinal axis from the initial position to the locking position.

8. A welding connector assembly according to claim 7, wherein the primary locking means comprises a primary lock including a conductive connector post projecting from the body of one of the pair of welding connectors and a socket formed in the body of the other of the pair of welding connectors, the post and the socket being adapted to draw the bodies of the welding connectors against one another, through camming coaction, upon rotation of the welding connectors relative to one another about the longitudinal axis from the initial position to the locking position.

9. A welding connector assembly according to claim 1, wherein, in each welding connector, the groove is defined by a channel formed on the interior of the tubular sleeve and by the exterior of the body.

10. A welding connector assembly according to claim 9, wherein the tongue portion is slightly bowed, so as to bear against each of the body and the sleeve to provide resistance to movement of the slide between the extended position and the retracted position.

11. A welding connector assembly according to claim 9, wherein a longitudinal slot is formed through each sleeve, contiguous with the channel thereof; and each slide also includes a button portion rigidly extending from the tongue portion through the slot, to permit digital manipulation of the slide between the extended position and the retracted position.

12. A welding connector assembly according to claim 11, wherein a slide is provided for each of said grooves, each slide being sufficiently shorter in length than the groove for which it is provided so as to permit any one of the slides to be disposed at its extended position when the other of the slides is disposed at its retracted position.

13. A welding connector assembly according to claim 7, wherein, in each welding connector, the sleeve is secured to the body by screws.

14. A welding connector assembly according to one of claim 1 to claim 13, wherein, in the initial position, the other ends of the sleeves abut, and wherein, upon rotation of the welding connectors relative to one another about the longitudinal axis from the initial position to the locking position, the other ends of the sleeves compress, so as to provide resistance against further relative rotation.

15. An improved welding connector of the type having a body constructed from electrically-conductive material and including receiver means for securely receiving in electrically-conducting relation an exposed end of a respective one of said welding cables; and a tubular sleeve constructed from electrically-insulative material, the sleeve, in use, forming a grip for the body and receiving the body in a manner which provides access to the receiver means of the body for the exposed end of the respective cable at one end and which provides access to the body at the other end, and of the type used in pairs for joining two welding cables the pair, in use, having:

an initial position wherein they define a longitudinal axis and wherein the tubular sleeves are disposed in end-to-end relation, aligned with the longitudinal axis and with the other ends of the tubular sleeves disposed adjacent one another;

primary locking means: for locking the welding connectors against longitudinal displacement from one another upon rotation of the welding connectors relative to one another about the longitudinal axis from the initial position to a locking position; and for permitting electrical conduction between the bodies when the welding connectors are locked against longitudinal displacement, the improvement comprising:

a groove formed in the welding connector, the groove being arranged such that, when a pair of the welding connectors are disposed at the locking position, the pair of grooves align with one another; and a slide for the groove, the slide including a tongue portion mounted for sliding longitudinal movement in the groove and moveable, through manual manipulation, between a retracted position, whereat it lies substantially within said groove, and an extended position, whereat it projects beyond said groove, such that, when a pair of the welding connectors is disposed at the locking position with the slide at the extended position, the slide extends from the groove of one of the pair into the groove of the other of the pair.

16. An improved welding connector according to claim 15, wherein the groove is defined by a channel formed on the interior of the sleeve and by the exterior of the body.

17. An improved welding connector according to claim 16, wherein the tongue portion is slightly bowed, so as to bear against each of the body and the sleeve to provide resistance to movement of the slide between the extended position and the retracted position.

18. An improved welding connector according to claim 17, wherein a longitudinal slot is formed through the sleeve, contiguous with the channel thereof; and the slide also includes a button portion rigidly extending from the tongue portion through the slot.

* * * * *